US012303735B2

(12) United States Patent
Fu

(10) Patent No.: US 12,303,735 B2
(45) Date of Patent: May 20, 2025

(54) INTERNAL TOOTHED MECHANISM FOR WEIGHT-ADJUSTABLE SAFETY DUMBBELL

(71) Applicant: Liwen Fu, Shanghai (CN)

(72) Inventor: Liwen Fu, Shanghai (CN)

( * ) Notice: Subject to any disclaimer, the term of this patent is extended or adjusted under 35 U.S.C. 154(b) by 159 days.

(21) Appl. No.: 18/224,738

(22) Filed: Jul. 21, 2023

(65) Prior Publication Data

US 2024/0408435 A1 Dec. 12, 2024

(30) Foreign Application Priority Data

Jun. 6, 2023 (CN) ..... 202321426381.0

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/0726; A63B 21/0728; A63B 21/075
See application file for complete search history.

(56) References Cited

U.S. PATENT DOCUMENTS

| | | | | |
|---|---|---|---|---|
| 7,578,772 | B2 * | 8/2009 | Lippitt | A63B 21/075 482/106 |
| 7,794,373 | B2 * | 9/2010 | Crawford | A63B 71/0054 482/107 |
| 10,195,477 | B2 * | 2/2019 | Marjama | A63B 21/0728 |
| 10,617,905 | B2 * | 4/2020 | Moran | A63B 71/0619 |
| 11,167,167 | B1 * | 11/2021 | Weng | A63B 21/0726 |
| 11,771,941 | B2 * | 10/2023 | Luo | A63B 21/075 482/108 |
| 11,806,568 | B1 * | 11/2023 | Hong | A63B 21/0726 |
| 2022/0331641 | A1 * | 10/2022 | Weng | A63B 21/075 |
| 2024/0198166 | A1 * | 6/2024 | Wang | A63B 21/075 |

FOREIGN PATENT DOCUMENTS

CN 212347552 U 1/2021

* cited by examiner

*Primary Examiner* — Joshua Lee
(74) *Attorney, Agent, or Firm* — Greenberg Traurig, LLP; Melissa Hunter-Ensor

(57) ABSTRACT

Disclosed is an internal toothed mechanism for a weight-adjustable safety dumbbell comprising a rotating disc and a stopper, wherein a middle section of the stopper is provided with a clamping groove, and a top end of the stopper is provided with a mounting hole for mounting a reset spring, and wherein the clamping groove defines an upper end surface and a lower end surface which are arc-shaped, and a plurality of top ratchets are arranged on the upper end surface of the clamping groove, and a plurality of inner ratchets are arranged on an inner wall of the rotating disc, wherein the top ratchets are engaged with the inner ratchets.

1 Claim, 3 Drawing Sheets

INTERNAL TOOTHED MECHANISM FOR WEIGHT-ADJUSTABLE SAFETY DUMBBELL

CROSS-REFERENCE TO RELATED APPLICATIONS

This application claims priority to Chinese Utility Model application No. 202321426381.0, filed on Jun. 6, 2023. The disclosure of the application is incorporated herein for all purposes by reference in its entirety.

TECHNICAL FIELD

The present disclosure relates to an exercising equipment, in particular relates to an internal toothed mechanism for a weight-adjustable safety dumbbell.

BACKGROUND

Existing dumbbells available in the market can be categorized into fixed-weight dumbbells and weight-adjustable dumbbells. When using fixed-weight dumbbells, a set of dumbbells with different weight are prepared to meet exercise requirements.

The Utility Model Patent with the patent publication number CN212347552U discloses a locking device for a novel weight-adjustable dumbbell. This patent provides a locking device for the weight-adjustable dumbbell, and its working principle is explained as follows: in a step of adding a weight plate, a handle sleeve is rotated, and the handle sleeve drives a slider to move via a guiding groove, such that the slider is inserted into an fixing hole of the weight plate; the handle sleeve, a limiting plate and a rotating disc 103 rotate synchronously when the handle sleeve is rotating, meanwhile, a stopper 104 is raised by a pin (as shown in FIG. 1) such that the stopper 104 disengages from a limiting groove 1031 and is not capable of restricting the rotation of the rotating disc 103; after the adjustment (of the weight plate) is completed, the dumbbell may be lifted for exercise; under the action of a reset spring 105, the stopper 104 engages into the limiting groove 1031 of the rotating disc 103 (as shown in FIG. 2) such that the stopper 104 restricts the rotation of the rotating disc 103, thereby preventing the handle sleeve from rotating and preventing the weight plate of the dumbbell from falling off during use.

However, the aforementioned patent still faces with some safety problems. For example, when rotating the handle sleeve for adjusting the number of weight plates, it is necessary to ensure that the stopper 104 is aligned with the limiting groove 1031. This alignment is crucial to ensure that the stopper 104 successfully engages with the limiting groove 1031 under the action of the reset spring 105 when the dumbbell is lifted. Although the above patent attempts to ensure the alignment of the stopper 104 with the limiting groove 1031 in such a way that a weight scale aligns with an indicator slot, there are still security risks. When rotating the handle sleeve, the user may not align the weight scales with the indicator slots due to carelessness or other reasons, so that the stopper 104 and the limiting groove 1031 are not properly aligned. As a result, an end of the slider may partially enter into the fixing hole of the weight plate to be loaded. The newly added weight plate may be elevated by the slider during the lift of the dumbbell, but the stopper 104 cannot enter into the limiting groove 1031, and the rotating disc 103 is thus not restricted. In such a situation, the user is prone to unintentionally manipulate the handle sleeve, leading to the detachment of the weight plate and potential injury to the user.

SUMMARY

The purpose of the present disclosure is to provide an internal toothed mechanism for a weight-adjustable safety dumbbell, which at least partially eliminates the potential safety hazards of locking devices of prior art due to structural reasons.

For solving the above technical problem, an internal toothed mechanism for a weight-adjustable safety dumbbell is provided, which includes a rotating disc and a stopper, wherein a middle section of the stopper is provided with a clamping groove, and a top end of the stopper is provided with a mounting hole for mounting a reset spring, and wherein an upper end surface and a lower end surface of the clamping groove are arc-shaped, and a plurality of top ratchets are arranged on the upper end surface of the clamping groove, and a plurality of inner ratchets are arranged on an inner wall of the rotating disc, wherein the top ratchets are engaged with the inner ratchets.

Compared to the prior art, the present disclosure provides the following advantageous effects: the ratchets arranged on the rotating disc and the stopper ensure the unidirectional rotation of the rotating disc; when the stopper is not properly aligned with the limiting groove, the stopper may not be smoothly engaged into the limiting groove during the process of lifting the dumbbell; however, the ratchets guarantee the unidirectional rotation of the handle sleeve, such that the stopper can be successfully engaged into the limiting groove, thereby preventing the weight plates from falling off during the use of the dumbbell. The arrangement of the present disclosure features a simple structure and effectively eliminates the potential safety hazards of locking devices of prior art due to the misalignment of the stopper and limiting groove, making it highly practical and functional.

BRIEF DESCRIPTION OF THE DRAWINGS

The present disclosure may be better understood with reference to the accompanying drawings and the embodiments described herein. These drawings are given for illustrative purposes only and are not meant to be limiting.

DETAILED DESCRIPTION

Figure 1:
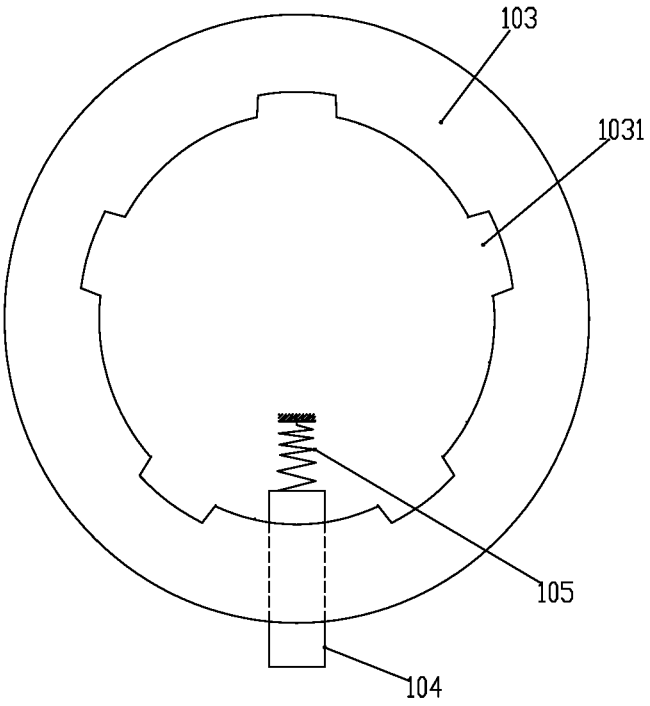
FIG. 1 (Prior Art)
FIG. 1 is a schematic diagram in which a stopper of the prior art is raised.
Figure 2:
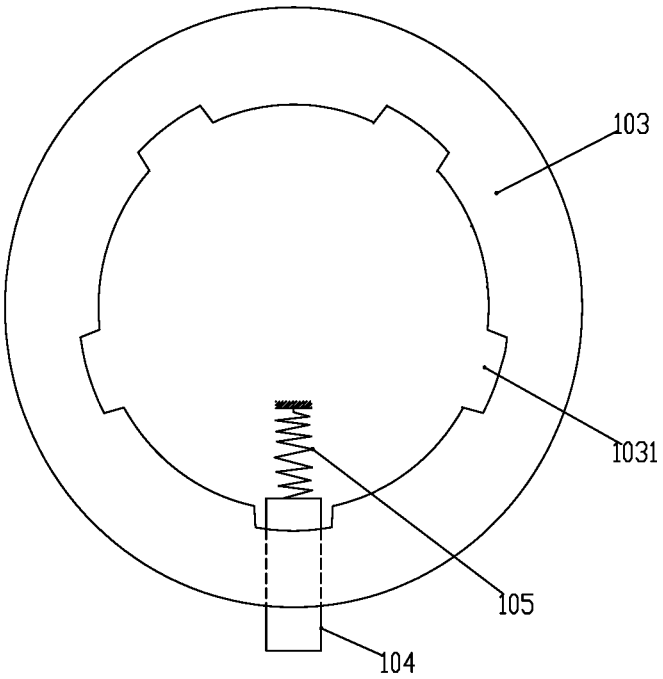
FIG. 2 (Prior Art)
FIG. 2 is a schematic diagram in which the stopper of the prior art is engaged into the limiting groove.
Figure 3:
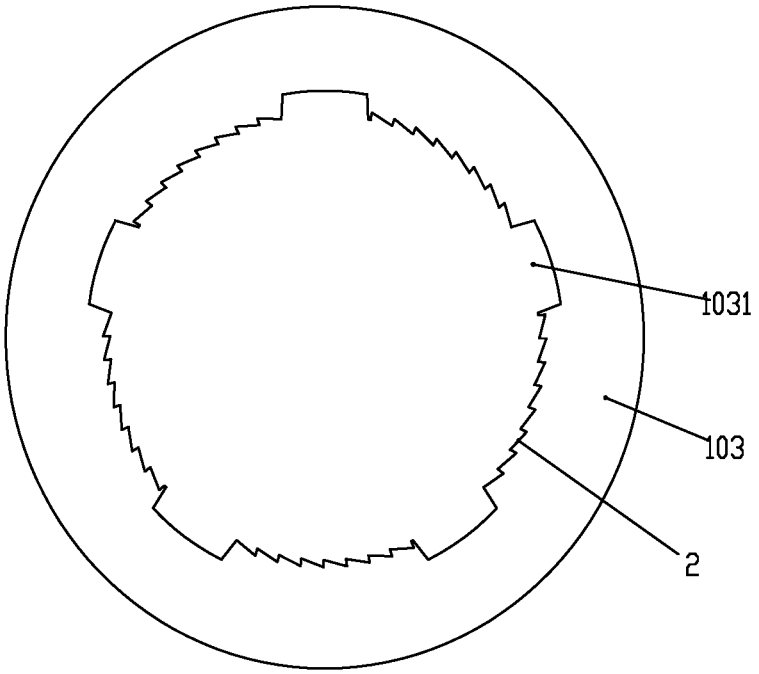
FIG. 3 is a schematic diagram illustrating the structure of a rotating disc.
Figure 4:
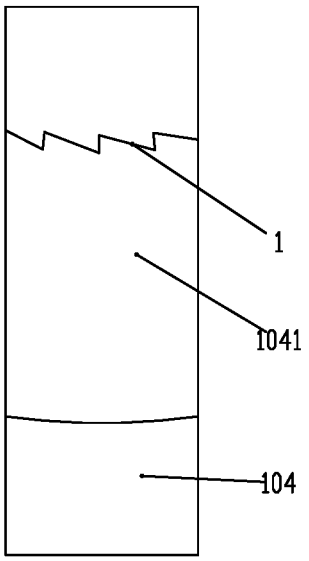
FIG. 4 is a front view of a stopper.
Figure 5:
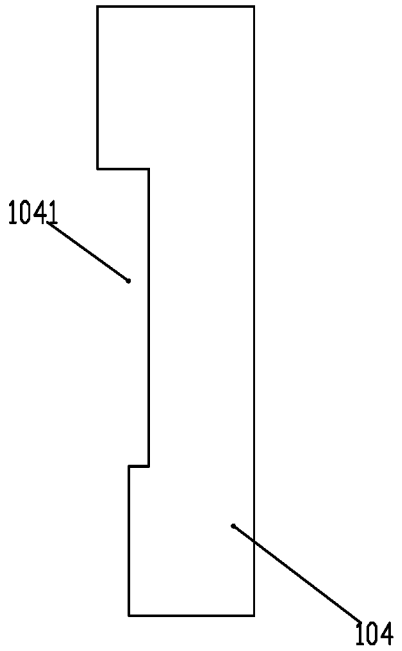
FIG. 5 is a side view of a stopper.

With reference to the accompanying drawings, the technical solution in the embodiments of the present disclosure will be described clearly and comprehensively. It should be appreciated that the described embodiments are only some of the embodiments of the present disclosure and not the entirety of the embodiments. Based on the embodiments disclosed in the present disclosure, all other embodiments that the ordinary skilled persons in the art can obtain without exercising creative labor fall into the protection scope claimed in the present disclosure.

The detailed description of the content of the present disclosure in conjunction with the embodiments is described below.

FIGS. 3-6 illustrate some embodiments of an internal toothed mechanism for a weight-adjustable safety dumbbell provided by the present disclosure.

The present disclosure provides an internal toothed mechanism for a weight-adjustable safety dumbbell comprising a rotating disc 103 and a stopper 104. The rotating disc 103 is circular in shape and has a plurality of limiting grooves 1031 on its inner wall. The stopper 104 is provided with a clamping groove 1041 at its middle portion, and the stopper 104 is provided with a mounting hole for mounting a reset spring 105 at its end (top end). The clamping groove 1041 defines an upper end surface and a lower end surface which are arc-shaped, and a plurality of ratchets 1 are arranged on the upper end surface of the clamping groove 1041, and a plurality of inner ratchets 2 are arranged on the inner wall of the rotating disc 103, wherein the plurality of top ratchets 1 are engaged with the plurality of inner ratchets 2 to ensure that the rotating disc 103 can only rotate in one direction.

The internal toothed mechanism of the weight-adjustable safety dumbbell in the embodiment can completely eliminate the safety hazards in the prior art. When a weight plate is added, the stopper 104 is in a raised state due to the action of a pin, and the height at which the stopper 104 is raised (for example, implemented by increasing the length of the stopper 104) ensures that the stopper 104 is disengaged from the limiting groove 1031, the upper end surface of the clamping groove does not come into contact with the inner wall of the rotating disc 103 (i.e., the top ratchets 1 does not engage with the inner ratchets 2). In this way, a handle sleeve can be freely rotated to adjust the position of the slider, thereby achieving addition or removing of the weight plates. After this adjustment, the dumbbell can be lifted for exercise by ensuring that the stopper 104 is in alignment with the limiting groove 1031, as indicated the alignment of the weight scale and the indicator slot.

Figure 6:
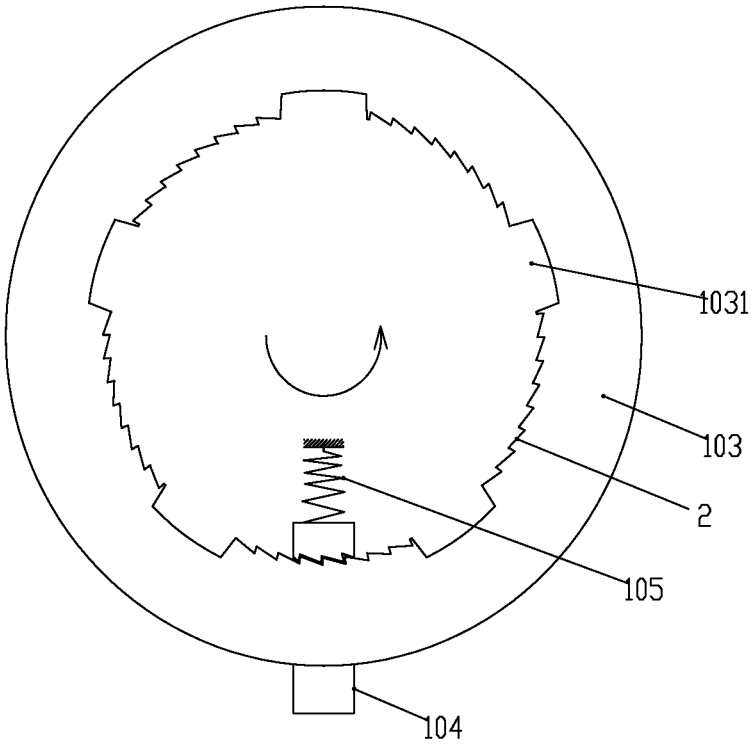
FIG. 6 is a schematic diagram illustrating the engagement between the rotating disc and the stopper.

If the user lifts the dumbbell for exercise without keeping the weight scale aligning with the indicator slot, the stopper will move a certain distance, under the action of the reset spring 105, so that the top ratchets 1 on the clamping groove engage with the inner ratchets 2 of the rotating disc 103. Due to the special structure of the inner ratchets 2 and the top ratchets 1, the rotating disc 103 can only rotate in one direction (as shown in FIG. 6, the rotation direction is indicated by an arrow), and the handle sleeve and the rotating disc 103 are in a fixed connection, which allows the handle sleeve to rotate in only one direction, and drives the slider to move outward until the stopper 104 enters into the limiting groove 1031. During the above process, the weight plates will not fall off, thus enhancing safety.

It should be noted that, as used herein, terms such as "comprising", "including" or any other variants are intended to encompass non-exclusive inclusion, such that a process, method, item, or device comprising a series of elements includes not only those elements explicitly listed but also includes other elements not expressly mentioned, or that are inherently included in such process, method, item, or device.

Although exemplary embodiments of the present disclosure have been shown and described, it will be understood by those skilled in the art that various changes, modifications, substitutions, and variations can be made to these embodiments without departing from the principles and spirit of the present disclosure. The scope of the present disclosure is defined by the appended claims and their equivalents.

The invention claimed is:

1. An internal toothed mechanism for a weight-adjustable safety dumbbell, comprising a rotating disc and a stopper, wherein the stopper is provided with a clamping groove at its middle portion and a mounting hole for mounting a reset spring at its top end, wherein the clamping groove defines an upper end surface and a lower end surface which are arc-shaped, and a plurality of top ratchets are arranged on the upper end surface of the clamping groove, and a plurality of inner ratchets are arranged on an inner wall of the rotating disc, wherein the top ratchets are engaged with the inner ratchets.

* * * * *